United States Patent [19]

Meisner

[11] 4,402,991

[45] Sep. 6, 1983

[54] PROCESS AND APPARATUS FOR ELECTROSTATICALLY COATING OBJECTS

[75] Inventor: Roland A. Meisner, Schorndorf, Fed. Rep. of Germany

[73] Assignee: BASF Farben & Fasern A.G., Hamburg, Fed. Rep. of Germany

[21] Appl. No.: 409,948

[22] Filed: Aug. 20, 1982

Related U.S. Application Data

[63] Continuation of Ser. No. 234,189, Feb. 13, 1981, abandoned.

[30] Foreign Application Priority Data

Feb. 15, 1980 [DE] Fed. Rep. of Germany ..... 3005677

[51] Int. Cl.[3] ..... B05D 1/04; B05D 1/06; B05D 5/00; B05B 5/04

[52] U.S. Cl. ..... 427/31; 118/626; 118/629; 239/3; 239/703; 427/240

[58] Field of Search ..... 118/626, 629; 239/3, 239/703; 427/31, 240

[56] References Cited

U.S. PATENT DOCUMENTS

| | | | |
|---|---|---|---|
| 3,393,662 | 7/1968 | Blackwell | 427/31 X |
| 3,418,971 | 12/1968 | Lamm | 427/31 X |
| 3,442,688 | 5/1969 | Pettigrew | 427/31 |
| 4,037,561 | 7/1977 | LaFave et al. | 118/626 X |
| 4,215,818 | 8/1980 | Hopkinson | 427/31 X |

*Primary Examiner*—Michael R. Lusignan
*Attorney, Agent, or Firm*—Wells & Wells

[57] ABSTRACT

Process for electrostatically coating objects with a fluid, for instance liquid paint, by applying a high voltage to a spray bell and by feeding the fluid to a revolving, driven spray bell. The flow-rate of the fluid supplied to the center of the spray bell is decelerated nearly to zero when it enters the bell, then the rate of the fluid is increased by being accelerated by the bell to 15,000 to 60,000 rpm, and the fluid thereupon is centrifuged off the spray rim of the bell and is guided to the object to be coated.

12 Claims, 2 Drawing Figures

PROCESS AND APPARATUS FOR ELECTROSTATICALLY COATING OBJECTS

This is a continuation, of application No. 234,189, filed Feb. 13, 1981, now abandoned.

BACKGROUND OF THE INVENTION

The invention relates to a process for electrostatically coating objects using a liquid, for instance liquid paint, by applying a high voltage to a spray bell and by feeding the fluid to the spray bell driven in revolving manner.

Methods and devices to electrostatically coat objects with paint are known in large numbers. Thus there are spray guns of the most diverse designs, wherein the paint means is sprayed by compressed air, or in airless manner. A needle-shaped high-voltage electrode is located at the spraying site, whereby, on account of the high concentration of field lines, an electrical charging of the spray mist takes place.

Moreover spraying systems are known, wherein the paint means is electrostatically removed as a thin film from a knife-edge. The feed of the paint means to the spray edge is implemented by gravity or centrifugal forces.

Lastly it is known that atomization is possible by high centrifugal forces, in the presence or absence of electric fields, where said atomization essentially comprises the advantages of the above cited methods. However this system suffers from the drawback that due to the design of the spray bell, even in the case of a central enamel supply, the paint means prior to atomization must pass sites of unstability (discontinuous changes in cross-section, jump in Coriolis acceleration), which entail changes in the paint means (for instance, entrainment of air). Moreover these systems require a central atomizing hub to feed the paint means to the spray edge. This atomizing hub is subjected to uncontrollable soiling.

SUMMARY

It is the object of the invention to create a process whereby a fluid, for instance liquid paint, can be sprayed onto an object to be treated, and for which, contrary to the previously known devices, even difficult coating materials, for instance "metallic enamel", can be processed, and a uniformly fine distribution of the paint will be assured, without any fears of air inclusions. The efficiency shall be substantially increased.

Another object of the invention is to create a simple, easily handled and operationally reliable apparatus for the implementation of the process.

The problem basic to the invention is resolved in that the feed rate of the fluid provided to the center of the spray bell is decelerated nearly to zero upon entry into the bell and that the rate then is increased by being accelerated by the bell to 15,000 to 60,000 rpm, and that thereupon said fluid will be centrifuged off the spray edge of the bell and guided to the object to be coated.

The apparatus to implement the process of the invention is characterized in that a diffusor is provided in the supply line of the fluid in the region of the line end. Further advantageous embodiments of the process of the invention and of the apparatus of the invention are (a) the energy transmission to the toroidal turbulence and the fluid film is carried out in shape-locking manner;

(b) after the fluid particles have been centrifuged off the spray bell rim (13), they receive an axial thrust by at least one gas-application;

(c) the spray mist fed back through the toroidal turbulence to the spray bell will first impinge on a closed fluid film, be absorbed by same and then be accelerated with it;

(d) a diffusor (12) is provided in the supply line (7) of the fluid in the region of the line end;

(e) a straightener screen (14) follows the diffusor (12) in the fluid path of flow as seen in the direction of flow;

(f) the inside of the spray bell (2) is provided with a radial toothing (15);

(g) at least one ring of nozzles (6) is arranged in the rear region of the spray bell (6) for the purpose of generating a circular sheet of air;

(h) the motor and bearing support space is separated by a dynamic seal from the fluid half space;

(i) the electric motor (5, 11) is hooked to high voltage and is operated through a fully isolated transformer; and (j) the angular speed of the motor is varied by changing the synchronous frequency.

Therefore, the operation of the process of the invention is such that the fluid flow centrally fed to the bell rotating preferably at 15,000 to 60,000 rpm is guided toward the moving inside bell surface while passing through the toroidal turbulence formed in the free half space and without detachment taking place, and that from there the fluid flow is made to pass by frictional or shape linkage to the spray edge. In this operation, the fluid flow is decelerated nearly to zero speed by a diffusor and a straightener screen. The position of the axis of spin is subject to no restrictions within wide limits.

An especially appropriate apparatus for implementing the process of the invention consists of a bell seated on a hollow shaft and driven by an external-rotor drive. The hollow shaft itself acts as the enamel channel which widens in the manner of a diffusor at the transition to the bell-inside before the fluid at that end passes through a straightener screen. The fluid is then made to pass in radially and rotationally symmetric manner due to the imparted forces from the toroidal turbulence into the fluted bell inside surface for the purpose of shape-locked transport. Rearwardly offset nozzle bores are arranged on one or more arcs of circle, one of which preferably exceeding the diameter of of the atomizing edge. The diameter of the arc-of-circle and the bore geometry are so selected in relation to the air flow rate that on the one hand the air supply around the rotating bell is assured, and on the other hand the sprayed off cone of enamel mist receives a defined axial thrust from the circular air sheet.

BRIEF DESCRIPTION OF THE DRAWINGS

An embodiment of the apparatus of the invention is discussed below in relation to the drawing.

DESCRIPTION OF THE PREFERRED EMBODIMENTS

Figure 1:
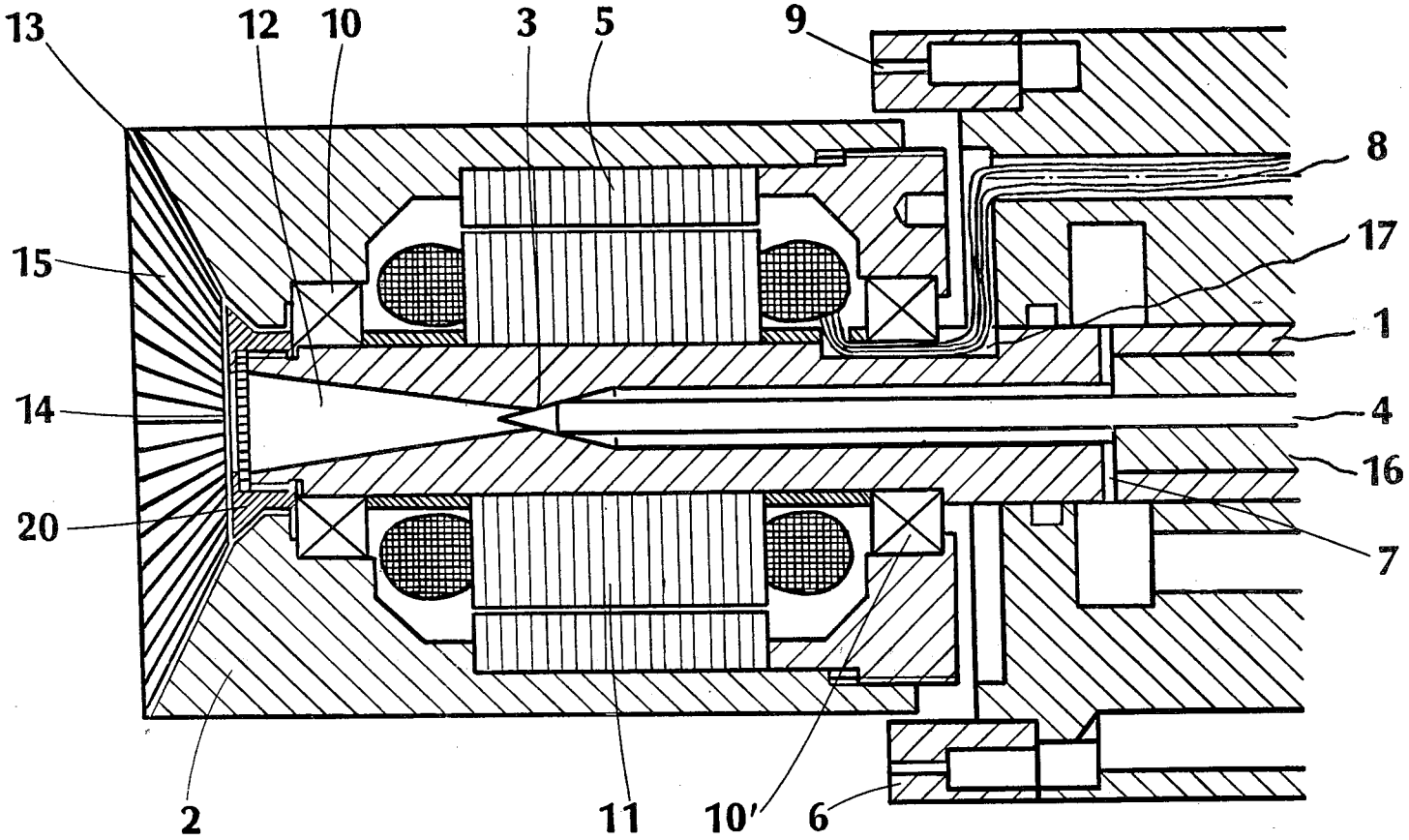
FIG. 1 is a cross-section of a first embodiment with an electrical drive.

The embodiment of FIG. 1 comprises the hollow shaft 1 which supports the bearings 10 and 10' of the bell 2 with rotor 5, stator 11 and dynamic seal 20 and the packing box 16. The electric supply line 8 for the stator is made to pass through a groove 17 in the hollow shaft through the bearing 10'. The hollow shaft terminates in a diffusor 12 which is closed off by a straightener screen 14. The intake of the diffusor is designed as a valve seat 3 from which the fluid flow can be blocked by means of the valve needle 4. To transmit the Coriolis force, the bell inside contour is provided with a radial toothing 15. The nozzle bores 9 of the ring of nozzles 6 generate a circular sheet of air which imparts an axial thrust to the mist of enamel sprayed off the rim 13. The enamel to be sprayed is introduced through line 7.

Figure 2:
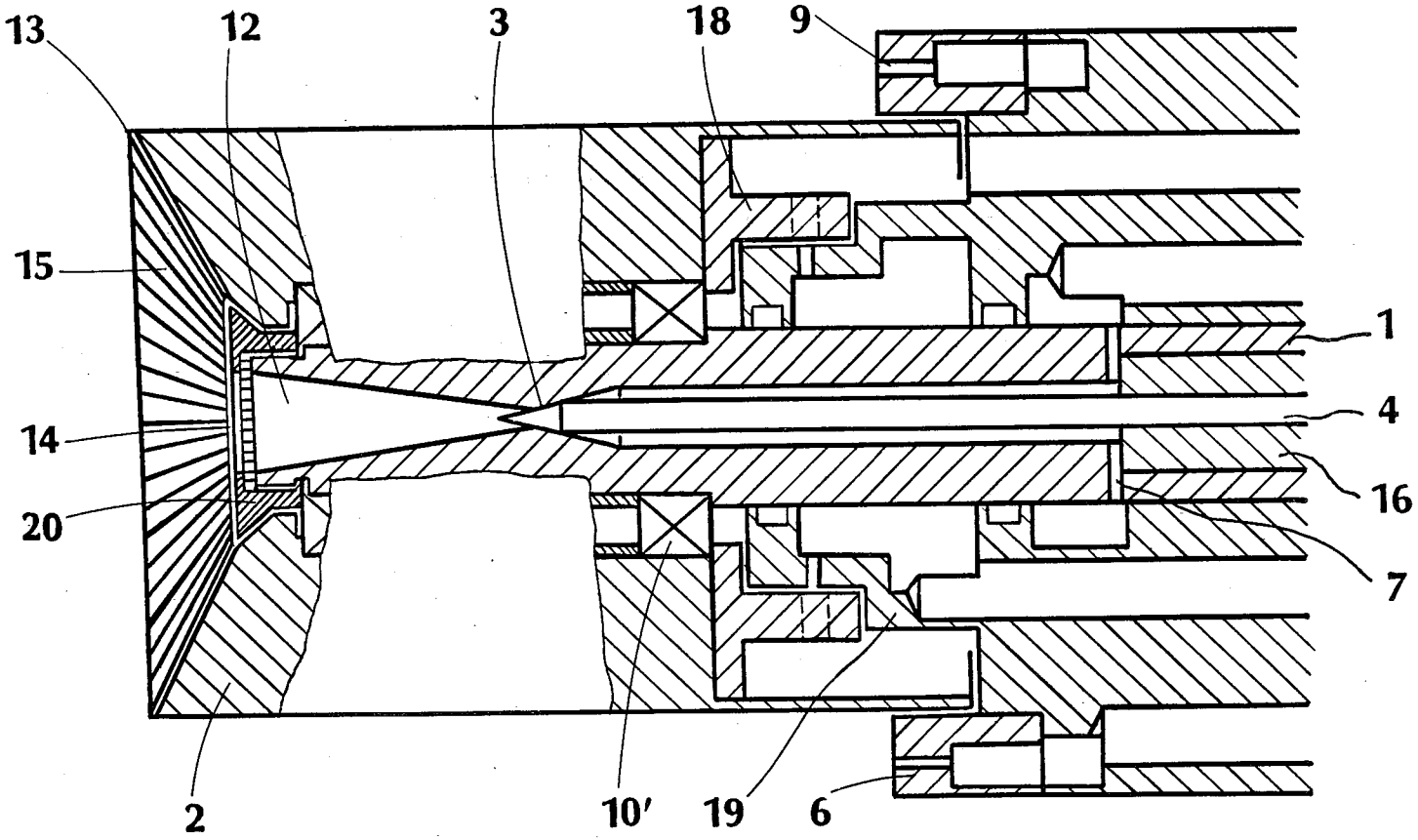
FIG. 2 is a cross-section of a modified embodiment with a pneumatic drive.

As regards the embodiment shown in FIG. 2, a pneumatic drive is used in lieu of the electrical one, comprising a turbine rotor 18 and a nozzle ring 19. Otherwise this embodiment in its operation agrees with that of FIG. 1.

I claim:

1. In a process for electrostatically coating objects with a fluid comprising paint by applying a high voltage to a spray bell and by feeding the fluid to a revolving, driven spray bell having a center and a rim, the improvement comprising:

(a) supplying said fluid to said center of the spray bell, said spray bell not having an atomizing hub;

(b) decelerating said fluid to approximately zero in the axial direction as it enters said spray bell;

(c) subjecting said fluid to a toroidal disturbance in the free space of said spray bell;

(d) increasing the flow rate of said fluid from approximately zero by accelerating said spray bell to 15,000 to 60,000 rpm; and (e) centrifuging said fluid off said spray bell rim and guiding said fluid to an object being coated.

2. The process of claim 1, further comprising shape locking the energy transmission to said toroidal turbulence and the fluid film.

3. The process of claim 1, further comprising applying at least one gas stream as an axial thrust to said fluid after said fluid has been centrifuged off said spray bell rim.

4. The process of claim 2, wherein spray mist is generated by said spray bell rim and any portion thereof which is fed back through the toroidal turbulence to the spray bell will first impinge on a closed fluid film, be absorbed by same and then be accelerated with it.

5. In an apparatus for electrostatically coating objects with a fluid by applying a high voltage to a spray bell and by feeding the fluid to a revolving, driven spray bell having a center and a rim, the improvement comprising:

(a) means for supplying said fluid to said spray bell center, said spray bell not having an atomizing hub;

(b) means for decelerating said fluid to approximately zero in the axial direction as it enters said spray bell;

(c) means for creating a toroidal disturbance in the free space of said spray bell to which said fluid is subjected;

(d) means for accelerating said spray bell to 15,000 to 60,000 rpm and increasing the flow rate of said fluid from approximately zero; and (e) means for centrifuging said fluid off said spray bell rim and guiding said fluid to an object being coated.

6. The apparatus of claim 5, wherein said means for supplying includes a supply line having an end and a diffuser is provided in the region of said end.

7. The apparatus of claim 6, wherein a straightener screen follows said diffuser in the fluid path of flow as seen in the direction of flow.

8. The apparatus of claim 6, wherein said spray bell has an inside and said inside is provided with radial toothing.

9. The apparatus of claim 6, wherein said spray bell has a rear region and at least one ring of nozzles is arranged in said rear region of said spray bell generating a circular sheet of air.

10. The apparatus of claim 6, further comprising a motor and bearing support space, a fluid half space and a dynamic seal separating said motor and bearing support space from said fluid half space.

11. The apparatus of claim 6, having an electric motor hooked to high voltage and operated through a fully isolated transformer.

12. The apparatus of claim 11, having means for changing the synchronous frequency and varying the speed of said motor.

* * * * *